US006088965A

United States Patent [19]

Fukumoto et al.

[11] Patent Number: 6,088,965

[45] Date of Patent: Jul. 18, 2000

[54] DOOR WINDOW REGULATOR

[75] Inventors: Ryoichi Fukumoto, Nagoya; Kazuya Makiuchi; Mamoru Nishihira, both of Sagamihara; Masakatsu Tsubouchi, Toyota, all of Japan

[73] Assignee: Aisin Seiki Kabushiki Kaisha, Kariya, Japan

[21] Appl. No.: 09/081,049

[22] Filed: May 19, 1998

[30] Foreign Application Priority Data

May 19, 1997 [JP] Japan ..... 9-142928

[51] Int. Cl.[7] ..... E05F 11/48

[52] U.S. Cl. ..... 49/352

[58] Field of Search ..... 49/348, 349, 352, 49/502, 374

[56] References Cited

U.S. PATENT DOCUMENTS

| | | | |
|---|---|---|---|
| 5,309,678 | 5/1994 | Adachi | 49/352 |
| 5,505,022 | 4/1996 | Shibata et al. | 49/352 |
| 5,528,861 | 6/1996 | Beyerlein | 49/352 |
| 5,799,441 | 9/1998 | Shibata | 49/352 |

FOREIGN PATENT DOCUMENTS

| | | |
|---|---|---|
| 58-78381 | 5/1983 | Japan . |
| 7-32877 | 2/1995 | Japan . |
| 7-305564 | 11/1995 | Japan . |

*Primary Examiner*—Jerry Redman

*Attorney, Agent, or Firm*—Burns, Doane, Swecker & Mathis, LLP

[57] ABSTRACT

A door and door window regulator which prevents the cable member from making contact with the door glass includes a door having inner and outer panels, a guide rail having one end connected to the outer panel and the other end connected to the inner panel, a window bracket slidably supported along the guide rail through a slide member and connected to a door window, and a guide bracket located on the guide rail and supporting a motor. A drum is supported on the guide bracket and is rotated through operation of the motor, and a pulley is supported on the guide rail at a position spaced from the drum. The cable member is wrapped around the drum and includes a pair of cable ends, one end of which is connected with the window bracket after passing through the pulley and the other end of which is directly connected with the window bracket from the drum. The portions of the cable member extending from the pulley are located generally parallel to the length of the guide rail.

14 Claims, 8 Drawing Sheets

DOOR WINDOW REGULATOR

This application corresponds to and claims priority under 35 U.S.C. § 119 with respect to Japanese Application No. 09(1997)-142928, the entire content of which is incorporated herein by reference.

FIELD OF THE INVENTION

The present invention generally relates to a window regulator. More particularly, the present invention pertains to a motor driven door window regulator that includes a wire cable for raising and lowering a door window or glass between an outer panel and a guide rail.

BACKGROUND OF THE INVENTION

One type of door window regulator is described in Japanese Unexamined Utility Patent Publication No. Syou. 58-78381, Japanese Unexamined Patent Publication No. Hei. 7-32877 and Japanese Unexamined Patent Publication No. Hei. 7-305564. The devices described in these documents include a guide rail fixed to a door, a window holder fixed to a door window and a pair of wire cable ends for slidably moving the window holder. The described device uses a motor having an output shaft that is associated with a drum. A wire cable is wrapped around the drum, or alternatively two wire cables are wrapped around the drum with one end of each wire cable being connected to the drum. In the case of a single wire cable, both ends of the wire cable are attached to the window holder. In the alternative case in which two wire cables are employed, one end of each wire cable is attached to the window holder.

In this device, when the motor rotates the drum winds up the wire cable around the drum or unwinds the wire cable off the drum. Therefore, the window holder with the door window moves up or down along the guide rail.

However, the device described above is susceptible of certain disadvantages and drawbacks. In one respect, the device is designed in such a way that the wire cable is not located within the width of the guide rail, thus making the device relatively large. Also, the wire cable faces the door window and so the wire cable can contact and rub the door window, thus resulting in inefficient operations and excessive part wear.

In light of the foregoing, a need exists for a door window regulator which is not susceptible of the disadvantages and drawbacks associated with other known devices.

It would be desirable to provide a door window regulator of reduced size that is designed in a way that reduces or eliminates the possibility that the wire cable will contact and rub against the door window.

It would also be desirable to provide a door window regulator which is efficient in operation and does not cause excessive part wear.

SUMMARY OF THE INVENTION

According to one aspect of the present invention, a door provided with a door glass regulator includes a door including an outer panel and an inner panel, a guide rail having one end connected to the outer panel and an opposite end connected to the inner panel, a window glass movable along a path of movement, and a window bracket connected to the window glass and slidably mounted on the guide rail through a slide member. A guide bracket is mounted on the guide rail and supports a motor, and a drum is supported on the guide bracket for being rotatably driven by the motor. A pulley is supported on the guide rail in a position spaced from the drum. A cable member is wrapped around the drum and includes, a first length terminating in a first end portion that extends around the pulley and is connected to the window bracket and a second length terminating in a second end portion that is connected to the window bracket. The first length extends from the drum to the pulley, the second length extends from the drum to the window bracket, and the first and second lengths extend substantially parallel to the lengthwise extent of the guide rail.

In accordance with another aspect of the invention, a door provided with a door glass regulator includes a door having inner and outer panels, a cable member, a guide rail having one end connected to the outer panel and an opposite end connected to the inner panel, a door glass movable along a path of movement, and a window bracket connected to the door glass and slidably mounted on the guide rail for sliding movement along the guide rail in a path of movement. The window bracket includes a metallic bracket located across the guide rail on a side of the guide rail containing the pathway for the cable member and a slide member mounted along sides of the guide rail and provided with first and second slots. A guide bracket is mounted on the guide rail and supports a motor, and a drum is supported on the guide bracket and rotatably driven by the motor. A pulley is supported on the guide rail in spaced apart relation to the drum, with the cable member being wound around the drum so that one portion passes around the pulley and is connected to the first slot through a spring while another portion extends from the drum and is connected with the second slot. One of the slots is oriented substantially parallel to the path of movement of the window bracket along the guide rail, and the other slot is oriented obliquely along a tangent line of the drum.

Another aspect of the present invention involves a door glass regulator that includes a guide rail having one end adapted to be connected to the outer panel of a door and an opposite end adapted to be connected to the inner panel of the door, and a window bracket for being slidably mounted on the guide rail through a slide member and adapted to be connected to a window glass. A guide bracket is mounted on the guide rail and supports a motor, while a drum is supported on the guide bracket for being rotatably driven by the motor. A pulley is supported on the guide rail in a position spaced from the drum, and a cable member is wrapped around the drum. The cable member includes a first length terminating in a first end portion that extends around the pulley and connected to the window bracket and a second length terminating in a second end portion and connected to the window bracket. The first length extends from the drum to the pulley and the second length extends from the drum to the window bracket, with the first and second lengths being located within the guide rail between the sides of the guide rail.

BRIEF DESCRIPTION OF THE DRAWING FIGURES

The foregoing and additional details and features of the present invention will become more apparent from the following detailed description considered with reference to the accompanying drawing figures in which like reference numerals refer to like parts and wherein.

DETAILED DESCRIPTION OF PREFERRED EMBODIMENT

Figure 1:
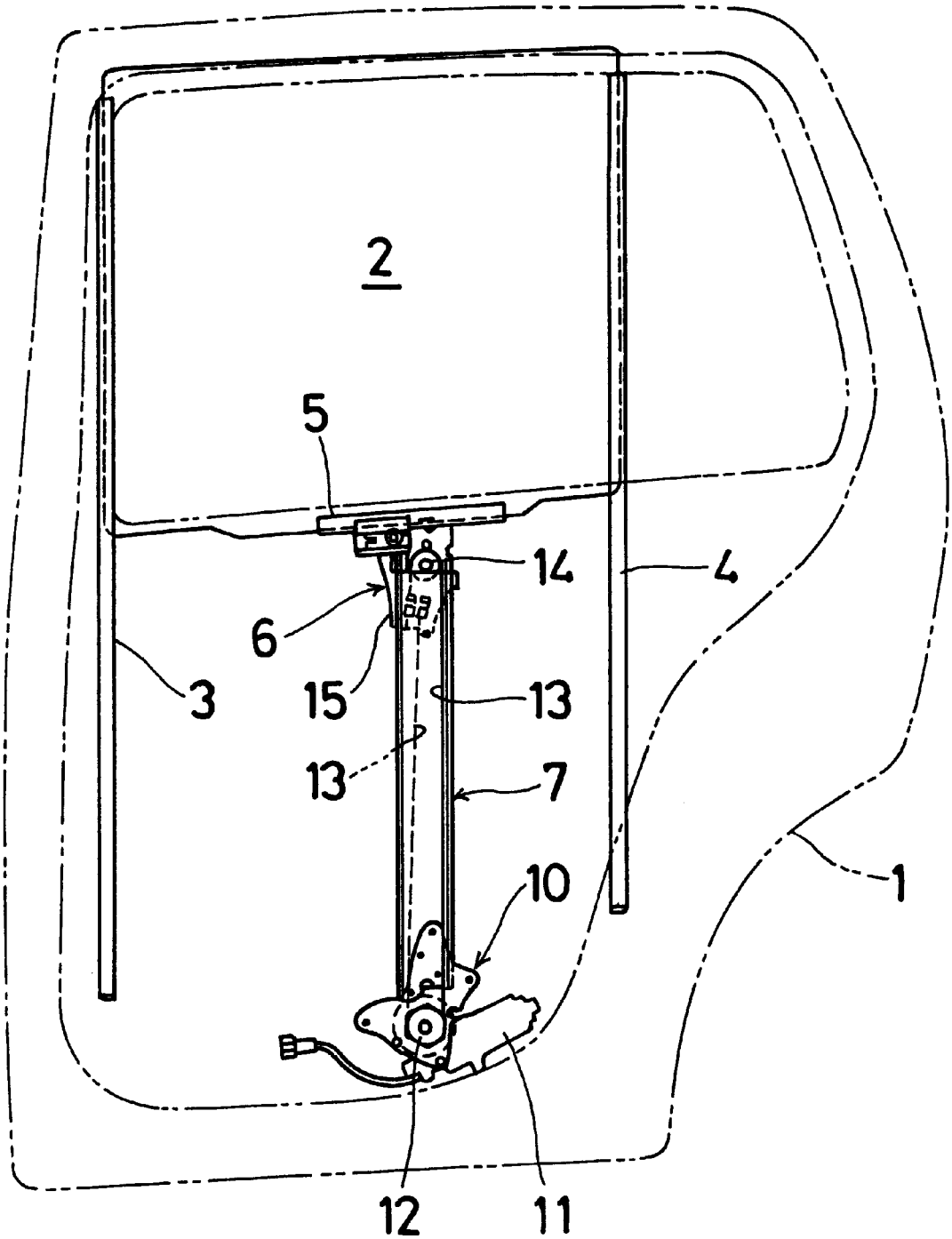
FIG. 1 is a front view of a vehicle door and a door window regulator in accordance with the preferred embodiment of the present invention.
Figure 2:
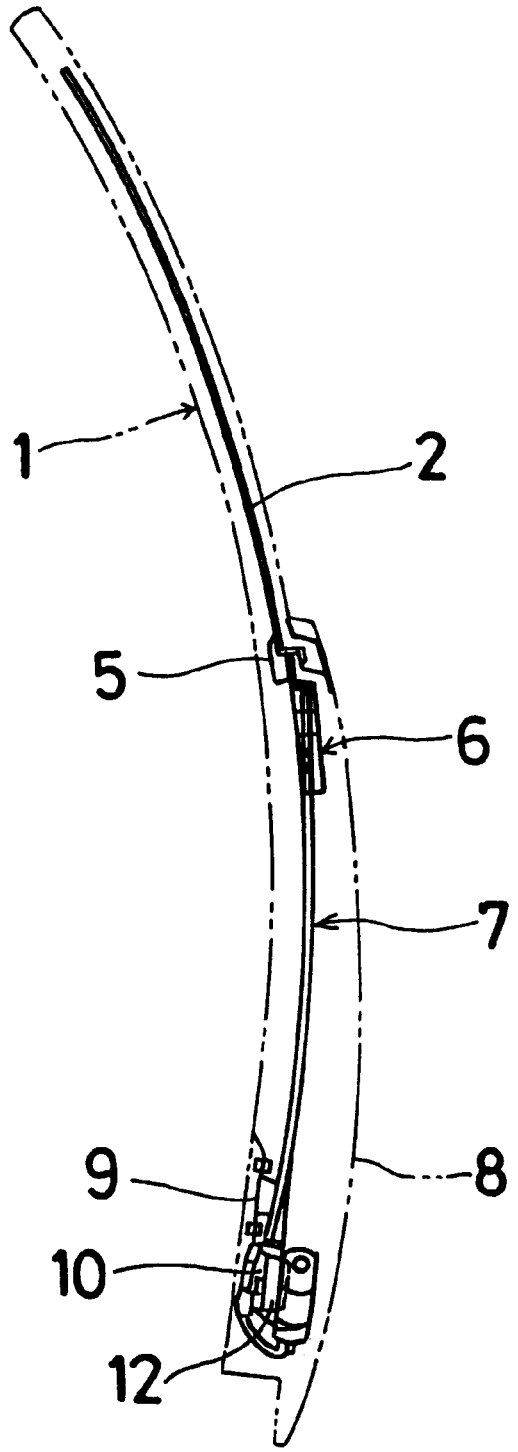
FIG. 2 is a side elevation view of the door window regulator shown in FIG. 1.

FIGS. 1 and 2 illustrate the structure of a vehicle door 1 in which is incorporated a door window 2. The door window 2 of the door 1 is slidably guided in a pair of frames 3, 4 that are disposed on opposite sides of the window 2. The frames 3, 4 are fixed to the door 1.

A window holder 5 is fixed to the bottom end of the door window 2 and is slidably supported on a guide rail 7 through a window bracket 6. The guide rail 7 is located between the path of movement of the door window 2 and the outer panel 8 of the door 1. The top end of the guide rail 7 is fixed to the outer panel 8 of the door 1 and the bottom end of guide rail 7 is fixed to an inner panel 9 of the door 1 through a guide bracket 10.

A motor 11 is supported on the guide bracket 10. A drum 12 is fixed on the output shaft of the motor 11 and a wire cable 13 is wound around the drum 12. A pulley 14 is rotatably supported on the top end of the guide rail 7. One end of the wire cable 13 passes through the pulley 14 and is connected to the window bracket 6, while the other end of the wire cable 13 is attached directly from the drum 12 to the window bracket 6 without passing through the pulley 14. Thus, the wire cable 13 includes a first length that terminates in a first end portion extending around the pulley and being connected to the window bracket 6 and a second length that terminates in a second end portion connected to the window bracket 6. Further, the first length of the wire cable 13 extends from the drum 12 to the pulley 14 while the second length of the wire cable 13 extends from the drum 12 to the window bracket 6, with both the first and second lengths extending in the direction of and substantially parallel to the length of the guide rail 7.

As shown in FIG. 2, the entire wire cable 13 is located on the outward-facing side of the guide rail 7. That is, the entire wire cable 13 is located on the side of the guide rail 7 that faces the outer panel 8 of the vehicle door. This outward-facing side is located in relatively close proximity to the outer panel 8 of the door. It is to be understood that while the description set forth above and the illustrations in the drawing figures depict a cable member in the form of a single wire cable, it is also possible to utilize a cable member in the form of two wire cables. In that event, one end of each wire cable would be connected to the drum 12 and the other end of each respective cable would be connected to the window bracket 6.

When the motor 11 rotates, the drum 12 winds up the wire cable 13 around the drum 12 or unwinds the wire cable 13 from the drum 12. This winding or unwinding of the cable 13 causes the window glass 2 to move up or down. The downward movement of the window glass corresponds to the winding up of the cable 13 around the drum 12 and the upward movement of the window glass corresponds to the unwinding of the wire cable 13 from the drum 12. The direction of rotation of the drum 12 corresponds to the rotation direction of the motor 11.

Figure 3:
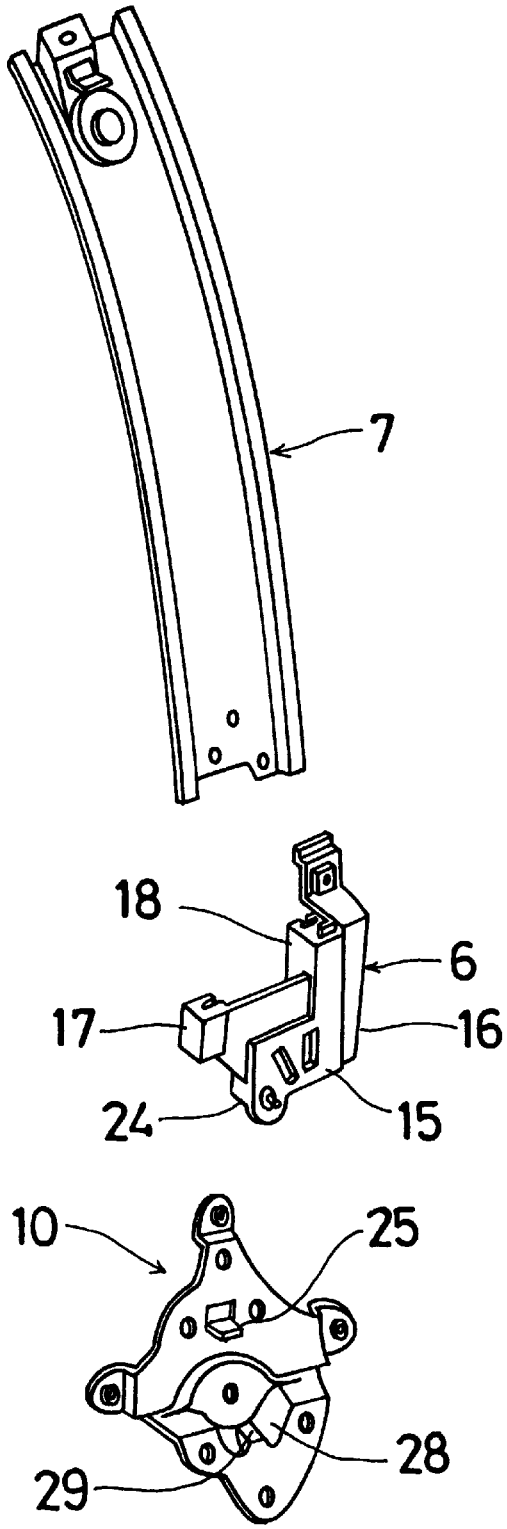
FIG. 3 is a perspective view of the guide rail, window bracket and guide bracket forming parts of the door window regulator of the present invention.

As shown in FIG. 3, the window bracket 6 includes a shoe 15 which is made of synthetic resin. The window bracket 6 of the preferred embodiment of the present invention is shown in greater detail in FIGS. 4–7. The window bracket 6 includes the shoe 15 made of synthetic resin and a metal bracket 16. The metal bracket 16 is fixed on the window holder 5 by a bolt 17 and the window holder 5 is located across the side of the guide rail 7 which contains the pathway for the wire cable. The shoe 15 is fitted within the metal bracket 16 so that the two parts form an integral structure. The shoe 15 includes three sliders 17*a*, 18, 18 that pinch or engage the guide rail 7. The sliders 18, 18 are slidably fitted on one of the side edges of the guide rail 7 while the slider 17*a* is slidably fitted on the opposite side edge of the guide rail 7. Although three sliders are illustrated, it is to be understood that two sliders could be used, one on each of the opposite side edges of the guide rail 7.

The outside diameter of the drum 12 and the outside diameter of the pulley 14 are smaller than the width of the guide rail 7. Therefore, the wire cable 13 is located entirely inside the width of the guide rail 7. Further, the guide rail 7 is channel-shaped and has two flanges forming the opposite side edges of the guide rail 7. These flanges extend towards the surface of the outer panel 8 and prevent the wire 13 from moving out beyond its pathway formed within the width of the guide rail 7.

A pair of slots or rectangular open sections 19, 20, constituting first and second slots, is provided in the shoe 15. Each of these slots or open sections respectively receive one end of the wire cable 13. Each end of the wire 13 includes a washer 21 which is fixed to the respective end of the wire cable 13 and a spring 22. The spring 22 on one end portion of the wire cable 13 is located between the washer 21 and the upper wall of the first slot 19 while the spring 22 on the opposite end portion of the wire cable 13 is located between the washer 21 and the lower wall of the second slot 20. Thus, each end of the wire cable 13 is fixed within the respective slot 19, 20.

The first slot 19 is located so that the long sides of the rectangular opening are parallel or generally parallel to the long sides of the guide rail 7. The second slot 20 is disposed to the side of the first slot 19 and at an inclined or slanting angle with respect to the first slot 19. The second 20 is preferably inclined relative to the first slot 19 such that the angle of the second slot 20 relative to the first slot 19 approximates the angle at which the cable 13 extends between the second slot 20 and the drum 12. The second slot 20 is thus obliquely wire member from the drum is obliquely along the tangent line of the drum The shoe 15 is also provided with a curved guide surface 23. The curved guide surface 23 guides the wire cable 13 which directly extends from the drum 12 so that the end of the wire cable 13 is guided into the slot 20.

The shoe 15 further includes a stopper 24 provided with a cushion. The stopper 24 is adapted to contact a protruding piece 25 of the guide bracket 10 to prevent the bottom portion of the window bracket 6 from traveling in a downward. motion past the point at which the stopper 24 and the protruding piece 25 make sufficient contact with one another.

The present invention provides a device which permits the door window 2 to move up and down without inordinately increasing the width of the guide rail 7 and through use of a relatively small window bracket 6.

Figure 4:
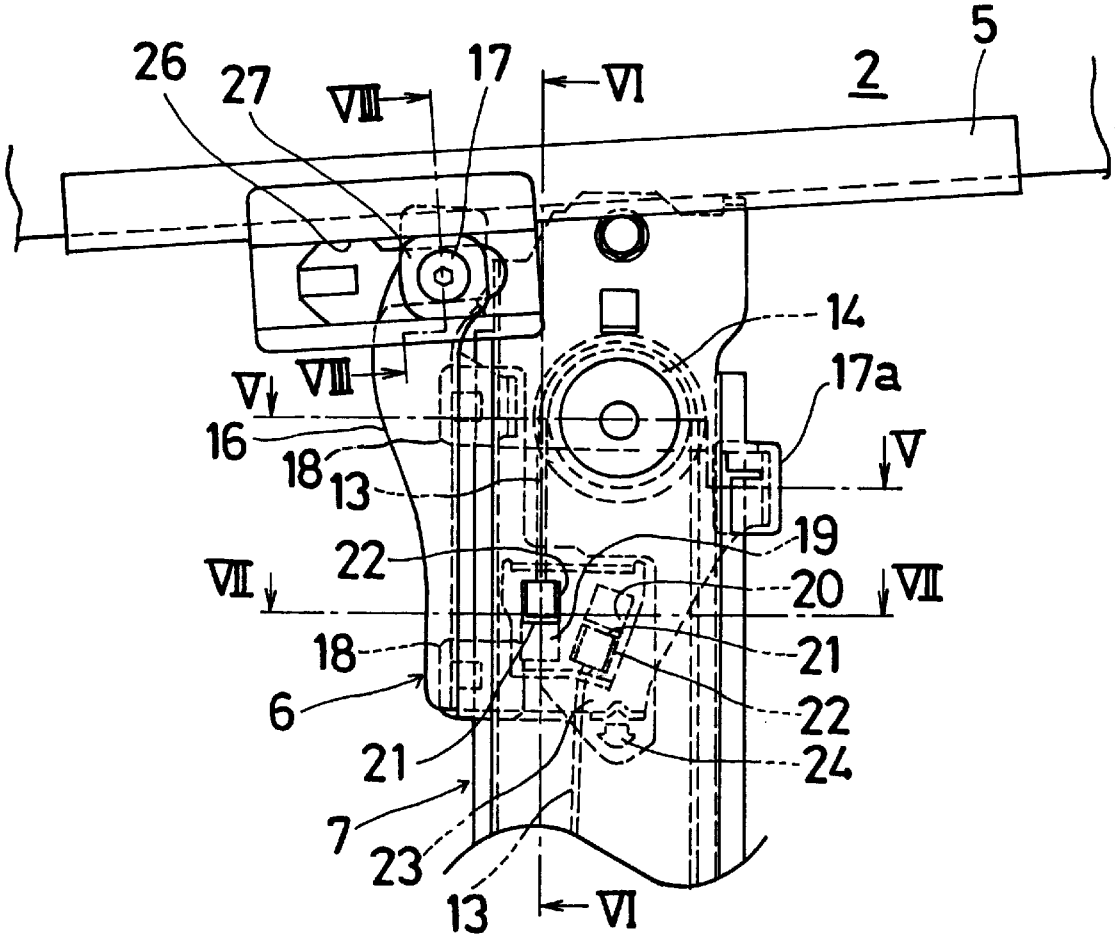
FIG. 4 is a front view of the window bracket and guide rail used in the door window regulator of the present invention.
Figure 5:
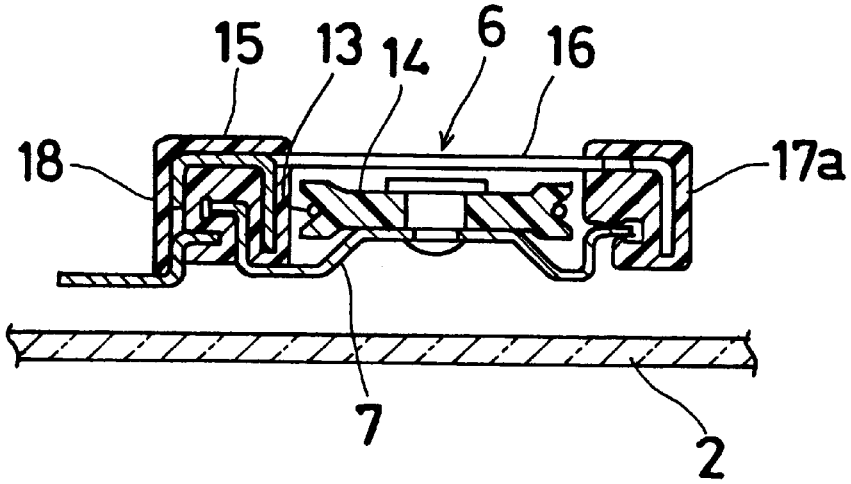
FIG. 5 is a cross-sectional view taken along section line V—V in FIG. 4.
Figure 6:
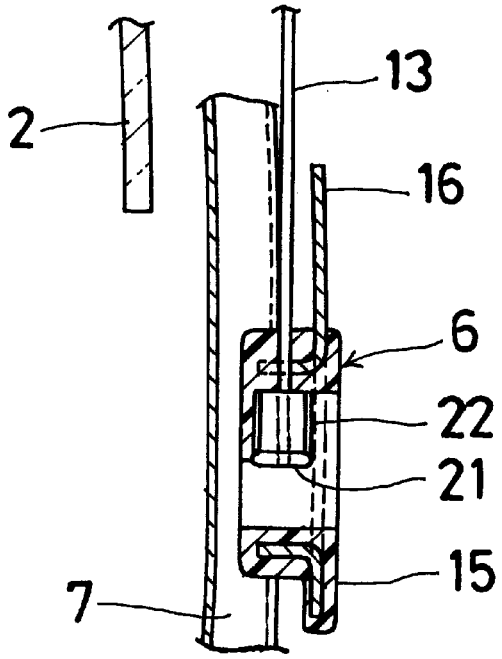
FIG. 6 is a cross-sectional view taken along section line VI—VI in FIG. 4.
Figure 7:
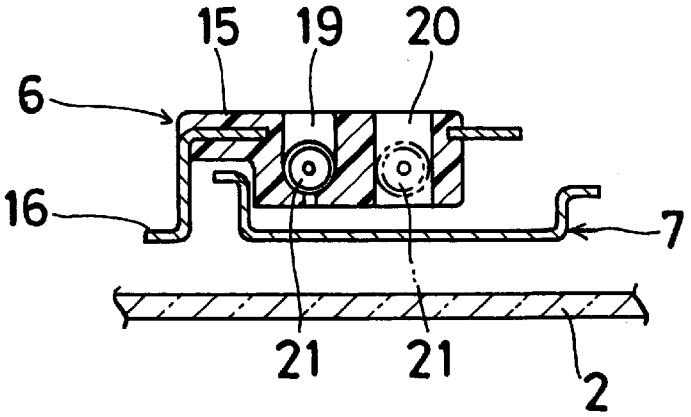
FIG. 7 is a cross-sectional view taken along section line VII—VII in FIG. 4.
Figure 8:
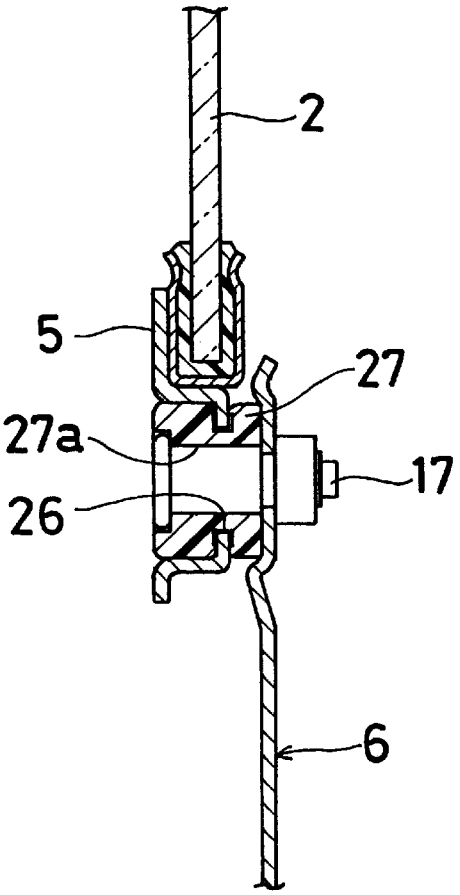
FIG. 8 is a cross-sectional view taken along section line VIII—VII in FIG. 4.

As shown in FIGS. 4 and 8, the window holder 5 includes an oblong hole 26 which extends underneath the bottom edge of the door window 2 and roughly parallel to the bottom edge of the door window 2. That is, the hole 26 is oblong or elongated in a direction that is generally parallel to the bottom edge of the door window 2. A sleeve 27 is received in the oblong hole 26 in the window holder 5 and the sleeve 27 possesses a through hole 27*a*. A bolt 17 is located within and extends through the hole 27*a* in the sleeve 27. This bolt 17 connects the sleeve 27 to the window bracket 6. The sleeve 27 is slidably supported by window holder 5.

Figure 10:
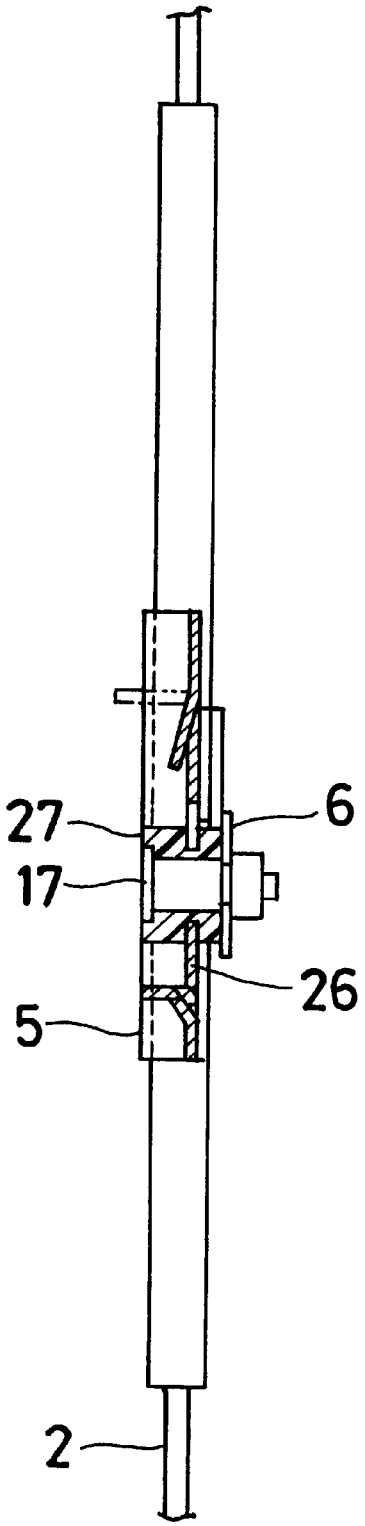
FIG. 10 is a cross-sectional view of the sleeve used in the door window regulator of the present invention.

As seen with reference to FIG. 10, a small gap exists between the hole 26 and the sleeve 27 so that the sleeve 27 is able to slide along the bottom end of the door glass 2. Thus, if a shock occurs when the door 1 is opened or closed, the sleeve 27 is able to slide to absorb the shock. Further, the sleeve 27 is able to slide to permit adjustment during assembling, thus facilitating the assembly operation.

Figure 9:
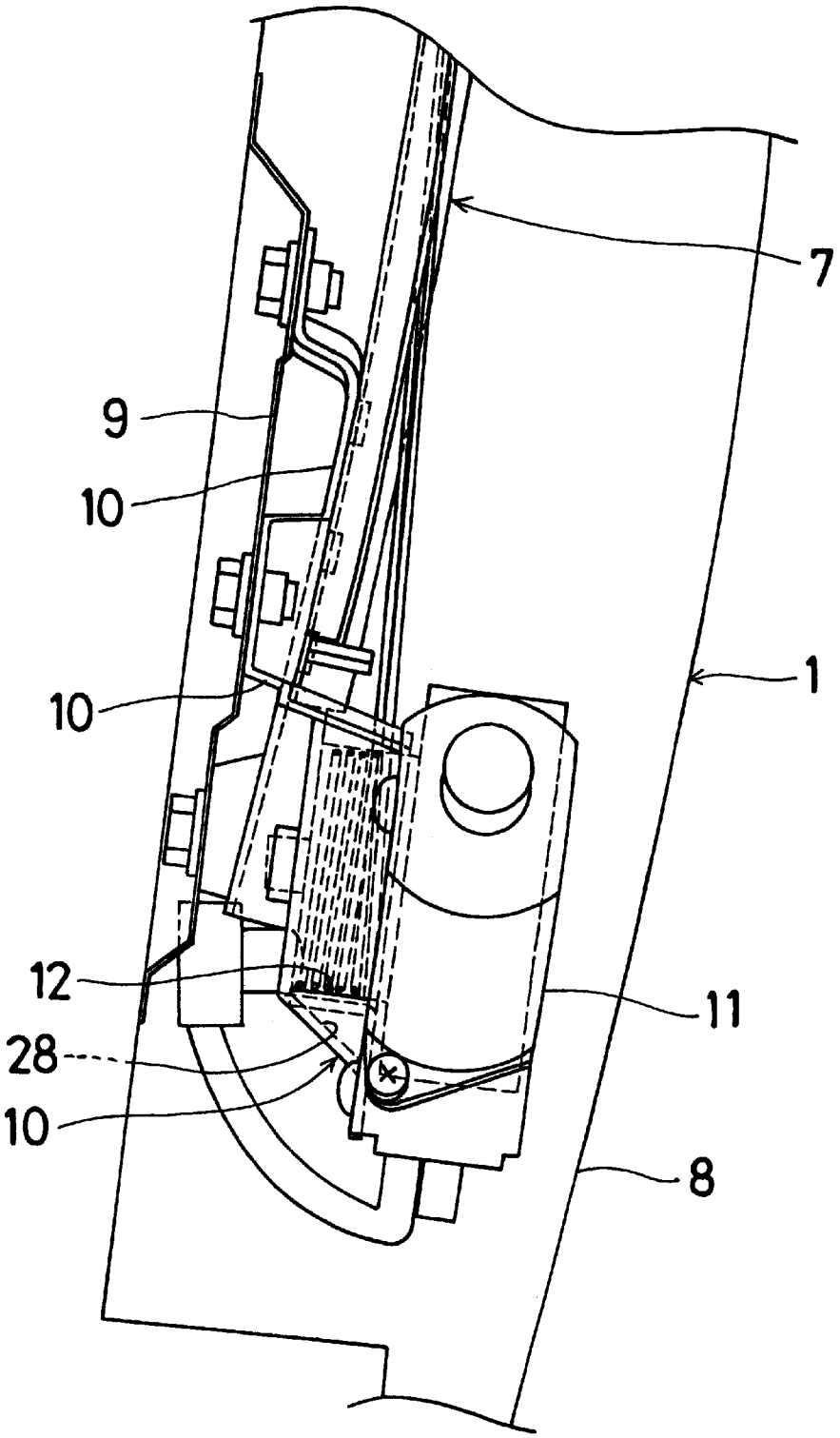
FIG. 9 is an enlarged side elevational view of the drum used in the door window regulator of the present invention.

As shown in FIGS. 3 and 9, the guide bracket 10 includes a depression 28 which, when viewed in cross-section, is generally semicircular in shape. This depression can be formed through a pressing operation. The drum 12 is located within this depression 28. The depression 28 also includes at least one wire cable supporting surface 29 positioned inside the depression 28. The wire supporting surface 29 prevents the wire 13 from coming off of the drum 12.

In the preferred embodiment of the present invention, the guide rail 7 is located between the path of movement of the door window 2 and the surface of outer panel 8 of the door 1. The wire cable 13 is located on the outside-facing side of the guide rail 7 (i.e., on the side of the guide rail facing the outer panel 8) while the locus or path of movement of the window glass 2 is located on the opposite side of the guide rail 7. Furthermore, the wire cable 13 is located entirely inside the width of the guide rail 7. Accordingly, the wire cable 13 is not liable to make contact with the surface of the window glass 2 during operation of the device. Consequently, excessive part wear and inefficient operation are avoided.

The principles, a preferred embodiment and the mode of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A door glass regulator, comprising:

a guide rail having one end to be connected to an outer panel of a door and an opposite end to be connected to an inner panel of the door, the guide rail having oppositely located sides extending along a lengthwise extent of the guide rail;

a window bracket for being connected to a window glass, the window bracket being located at one of the oppositely located sides of the guide rail and slidably mounted on the guide rail through a slide member;

a guide bracket mounted on the guide rail and supporting a motor;

a drum supported on the guide bracket for being rotatably driven by the motor;

a pulley supported on the guide rail in a position spaced from the drum; and a cable member wrapped around the drum and including a first length terminating in a first end portion that extends around the pulley and is connected to the window bracket and a second length terminating in a second end portion that is connected to the window bracket, the first length extending from the drum to the pulley and the second length extending from the drum to the window bracket, the first and second lengths being located at the other of the oppositely located sides of the guide rail and within the guide rail between the sides of the guide rail, the guide rail including a flange on each side of the guide rail, the first and second lengths being located between the flanges.

2. A door provided with the door glass regulator according to claim 1, wherein the guide rail is located between the path of movement of the window glass and the outer panel of the door.

3. The door provided with a door glass regulator according to claim 2, wherein the cable member is located on a side of the guide rail which faces towards the outer panel of the door, and the cable member is located inside longitudinally extending sides of the guide rail.

4. The door provided with a door glass regulator according to claim 3, wherein the guide bracket includes a depression which is substantially semicircular in shape as viewed in cross-section, said depression supporting the drum.

5. The door provided with a door glass regulator according to claim 4, wherein the depression includes a wire supporting surface for preventing the wire from coming off of the drum.

6. The door provided with a door glass regulator according to claim 5, wherein the window bracket includes a metallic bracket located across a side of the guide rail defining a pathway for the wire cable and a slide member slidably supported along side edges of the guide rail, the slide member being made of resin material and being provided with first and second slots, the first slot supporting one end of the cable member through a spring located within the first slot, and the second slot supporting another end of the cable member through a spring located within the second slot.

7. The door provided with a door glass regulator according to claim 6, wherein the first slot supports the end of the cable member located at the end of the first end portion of the cable member, said first slot being parallel to a path of sliding movement of the window bracket, the second slot being inclined relative to the first slot.

8. The door provided with a door glass regulator according to claim 7, wherein the slide member includes a curved guide surface which makes contact with and guides the second length of the cable member.

9. The door provided with a door glass regulator according to claim 8, wherein the guide bracket includes a protruding piece for contacting the slide member during movement of the window bracket to restrict a bottom-most position of the window bracket.

10. The door glass regulator according to claim 1, wherein the window bracket includes a metallic bracket and a slide member slidably supported along side edges of the guide rail, the slide member being provided with first and second slots, the first slot supporting one end of the cable member through a spring located within the first slot, and the second slot supporting another end of the cable member through a spring located within the second slot.

11. The door glass regulator according to claim 10, wherein the first slot is parallel to a path of sliding movement of the window bracket, the second slot being inclined relative to the first slot.

12. The door glass regulator according to claim 10, wherein the slide member includes a curved guide surface which makes contact with and guides the second length of the cable member.

13. The door glass regulator according to claim 10, wherein the guide bracket includes a protruding piece for contacting the slide member during movement of the window bracket to restrict a bottom-most position of the window bracket.

14. A door glass regulator, comprising:

a guide rail having one end to be connected to an outer panel of a door and an opposite end to be connected to an inner panel of the door, the guide rail having oppositely located sides extending along a lengthwise extent of the guide rail;

a window bracket for being connected to a window glass, the window bracket being slidably mounted on the guide rail through a slide member;

a guide bracket mounted on the guide rail and supporting a motor;

a drum supported on the guide bracket for being rotatably driven by the motor;

a pulley supported on the guide rail in a position spaced from the drum; and a cable member wrapped around the drum and including a first length terminating in a first end portion that extends around the pulley and is connected to the window bracket and a second length terminating in a second end portion that is connected to the window bracket, the first length extending from the drum to the pulley and the second length extending from the drum to the window bracket, the first and second lengths being located within the guide rail between flanges disposed on each side of the guide rail.

* * * * *